United States Patent [19]

Daunheimer

[11] 4,128,076

[45] Dec. 5, 1978

[54] APPARATUS FOR DECORATING EMBOSSED PANELS

[75] Inventor: Lyn R. Daunheimer, Batavia, Ill.

[73] Assignee: Masonite Corporation, Chicago, Ill.

[21] Appl. No.: 719,069

[22] Filed: Aug. 30, 1976

[51] Int. Cl.[2] ..... B05C 11/02

[52] U.S. Cl. ..... 118/70; 118/104; 118/109; 118/119; 118/DIG. 9

[58] Field of Search ..... 118/104, 109, 119, 118, 118/110, DIG. 9, 261, 70; 427/368, 264

[56] References Cited

U.S. PATENT DOCUMENTS

| | | | |
|---|---|---|---|
| 687,481 | 11/1901 | Kammerer et al. | 118/70 |
| 2,236,239 | 3/1941 | Lipton | 118/70 |
| 3,693,585 | 9/1972 | Reeve et al. | 118/104 |
| 3,908,588 | 9/1975 | Daunheimer et al. | 118/109 X |
| 3,936,541 | 2/1976 | Plowman et al. | 118/122 X |
| 3,936,549 | 2/1976 | Kohler et al. | 118/262 X |

*Primary Examiner*—John P. McIntosh
*Attorney, Agent, or Firm*—Richard H. Anderson

[57] ABSTRACT

A method and apparatus for decorating embossed panels by removing liquid colorant from portions of the surface. The apparatus includes at least one driven support roll underlying the panels for moving the panels along a work path and at least one wiping roll supported on an axis above the work path having a cylindrical resilient wiping surface driven at a speed for wipingly engaging an upper surface of the panels passing under the wiping roll on the work path. The wiping roll is supported and biased for movement toward and away from the work path to provide selectively adjustable wiping pressure against the surface of the moving panels and a doctor blade angularly engages the wiping surface of the wiping roll along a line spaced away from the area of wiping contact between the panels and the wiping roll for removing liquid colorant from the wiping surface of the roll. A removable trough system adjacent opposite ends of the doctor blade is provided for receiving the liquid colorant removed from the wiping surface of said wiping roll. The support roll is positioned to rotate with a lower portion of the roll in a liquid containing pan so that the roll is continuously wetted and the underside of the panels are thus wetted as they are driven along the work path. The lower support rolls are also provided with doctor blades to remove excess moisture. A push bar actuated safety shut-off system is provided at opposite ends of the apparatus for emergency stoppage of the rolls.

11 Claims, 5 Drawing Figures

24A
24B
24C
24D
24E
4
5
A
12
14
16
18
19
20
22
28
44
46
48
50
52
54
56
60
62
64
66
70
72
78
80
86
96
98
100
108
110
112
113
120
122
124
126
128
130
132
134
136
138
140
150
152
154
154a
154b
158
164
170
184
186
188
190

24A
24B
24C
24D
24E
10
12
14
16
18
19
20
22
22a
30
44
46
48
50
52
54
60
64
70
72
78
80
96
116
128
136
150
154b
156
158
159a
160
162
164
166
168
170
172
174

APPARATUS FOR DECORATING EMBOSSED PANELS

BACKGROUND OF THE INVENTION

This invention relates to a new and improved apparatus used for establishing a multiple coloration effect on embossed decorative paneling and the like. More specifically, the present invention relates to a method and apparatus for providing a different coloration in embossed or depressed areas on the surface of a panel by coloring the entire surface of the panel, including the embossed or depressed areas, and thereafter utilizing the apparatus of the present invention to wipe off and remove the freshly applied colorant from the higher portions of the surface of the panel, thus, leaving the colorant only in the embossed or depressed areas.

The apparatus of the present invention is capable of wiping off and removing freshly applied colorant from the higher portions of the surface of a panel so that the entire surface of the panel can first be stained, painted, or otherwise colored to establish coloration over the higher portion. After this first coat of colorant has dried, the entire surface of the panel is then overcoated completely with a second colorant to establish a second color in the embossed or depressed areas of the surface. Apparatus in accordance with the invention is used soon after this second coloration to wipe off and remove the second coloration from only the higher portions of the surface and force at least some of the colorant into the lower areas of the panel thereby revealing the first coloration on these higher portions.

DISCUSSION OF THE PRIOR ART

In accordance with common procedures in decorating the surface of a panel such as wood or hardboard panels and the like, the panel is formed with embossed or depressed areas representing a design such as wood ticking and wood graining, and it is desirable to color these depressed or embossed areas more darkly than the coloration applied to the surface of higher portions of the panel. According to the prior art, the entire panel is first stained or colored with a darker color to provide the depressed or embossed areas with the desired dark coloration. After the stain has dried, the higher portions of the panel are then painted or colored a lighter color to provide a distinct color highlighting difference between the embossed or depressed areas and the higher portions on the surface of the panel.

One problem experienced in providing a color highlighting for the surface of a panel by using the method described above, is that in coloring the higher portions of the panel, some of the light colored paint or pigmentation runs over or flows into the depressed or embossed areas. This phenomenon which is known as "flashing" in the art, renders much of the color highlighting ineffective as between the depressed or embossed areas and the higher portions of the panel and changes somewhat the original design imparted by the depressed or embossed areas, which design is necessary in effectively simulating the appearance of natural wood.

In accordance with the present invention, the problem of "flashing" is eliminated by reversing the steps of the procedure in coloring a panel in that the higher portions of the panel are colored first, and thereafter the depressed or embossed areas are more darkly colored. The darker coloration which is applied over the higher portions of the panel is then completely removed with the apparatus of the present invention to reveal the intended lighter coloration of those higher areas applied in the first coloration step while applying additional stain in the embossed areas due to the wiping action.

The following patents disclose an apparatus for cleaning the surface of cylinders used in printing or duplicating machines: U.S. Pat. Nos. Eckhard 1,854,694; Woodbury 1,878,565; Gegenheimer 2,970,541; Giori 2,987,993; De Feuchin 3,316,838; Giori 3,389,656; Granger 3,585,932; Giori 3,656,431; Trant et al 3,730,087; Gazzola et al 3,762,319; Cleyberg 3,771,450; Giori 3,758,286. These patents generally relate to means for cleaning ink from rollers. The Plowman et al U.S. Pat. No. 3,936,541; Reeves et al U.S. Pat. No. 3,693,585 and Buckley U.S. Pat. No. 3,247,047 relate to the art of color highlighting of the depressed or embossed and higher portions on the surface of embossed panels.

SUMMARY OF THE INVENTION

The foregoing and other objects and advantages of the apparatus of the present invention are accomplished in an illustrated embodiment comprising a new and improved apparatus for removing liquid colorant from portions of the embossed surface of sheet materials such as decorative panels and the like. The apparatus includes at least one driven support roll for moving the panels along a work path and at least one driven wiping roll mounted above the work path including a cylindrical, resilient wiping surface for higher portions of the engaging upper surface of the panels passing under the wiping roll along the work path. The wiping roll is driven with a peripheral speed at least 15% different than the supporting drive roll so that wiping contact is assured at the area of engagement between the panels and the resilient wiping surface on the wiping roll. A bearing system is provided for resiliently supporting the wiping roll for movement toward and away from the work path so that selectively adjustable wiping pressure is obtained between the wiping surface and the surface of the panels. A doctor blade angularly engaging the wiping surface is provided for engaging the wiping surface of the wiping roll along a line spaced away from the area of wiping contact with the moving panels for removing the liquid colorant material which has been picked up from the panels by wiping roll. Adjacent opposite ends of the blade, there is provided a trough system for receiving and carrying away the liquid colorant removed from the wiping surface of the wiping roll by the blade.

The driven support rolls are mounted so that a lower portion of rolls are in contact with liquid carried in a pan and the wetted surface of the rolls contacts the underside of the panels moving along the work path. The support rolls are provided with doctor blades to remove excess liquid.

BRIEF DESCRIPTION OF THE DRAWINGS

For better understanding of the present invention, reference should be had to the following detailed description taken in conjunction with the drawings, in which.

DESCRIPTION OF THE PREFERRED EMBODIMENT

Figure 1:
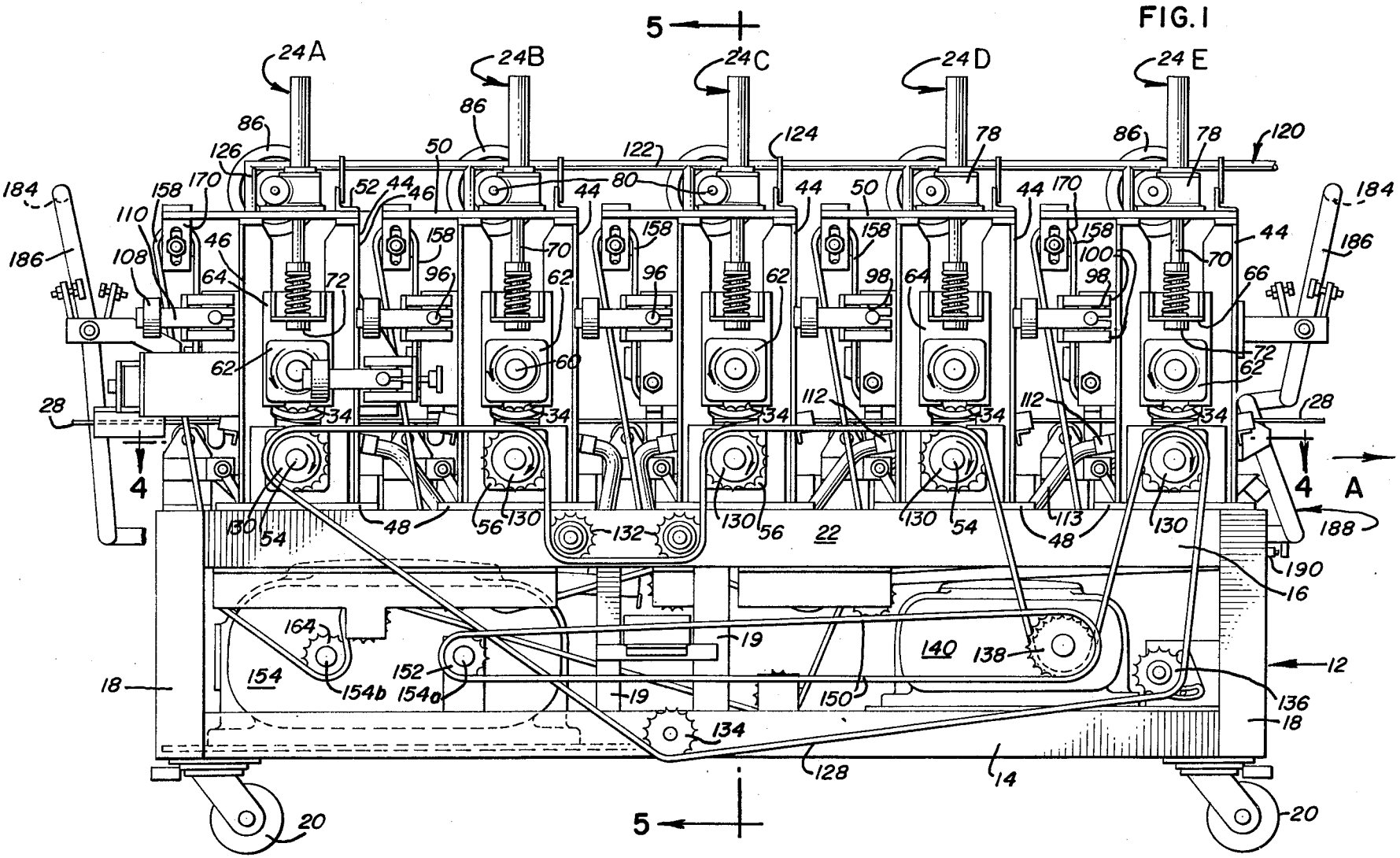
FIG. 1 is a side elevational view of a new and improved apparatus for removing liquid colorant from the surface of sheet material such as decorative panels and the like constructed in accordance with the features of the present invention.

Referring now more particularly to the drawings, therein is illustrated a new and improved apparatus for removing liquid colorant from the embossed surface of sheet material such as decorative panels and the like constructed in accordance with the features of the present invention and referred to generally by the reference numeral 10. The apparatus 10 includes a frame or base structure 12 having a rectangular, horizontal lower frame section 14 formed of angles and a similar upper rectangular horizontal section 16 also constructed of angles. The rectangular upper and lower horizontal frame sections 14 and 16 are spaced apart and interconnected by a plurality of vertical corner posts 18 and a plurality of smaller intermediate posts 19 formed of angles. In order that the apparatus 10 may be moved conveniently from place to place, the base or frame structure 12 is supported on a plurality of locking type caster assemblies 20, which casters may swivel when unlocked and then may be locked into position with the wheels of the casters aligned longitudinally of the apparatus 10.

The upper frame section 16 includes a pair of relatively heavy, longitudinally extending side frame members such as the angles 22 and these angles are aligned with their upper flanges **22*a* in a horizontal plane to provide a relatively secure and heavy duty support for a plurality of transversely extending drive and wiping roll assemblies indicated by the reference numerals 24A through 24E. The respective drive and wiping roll assemblies 24A through 24E** are substantially identical and accordingly, only one assembly will be described herein in detail.

Figure 3:
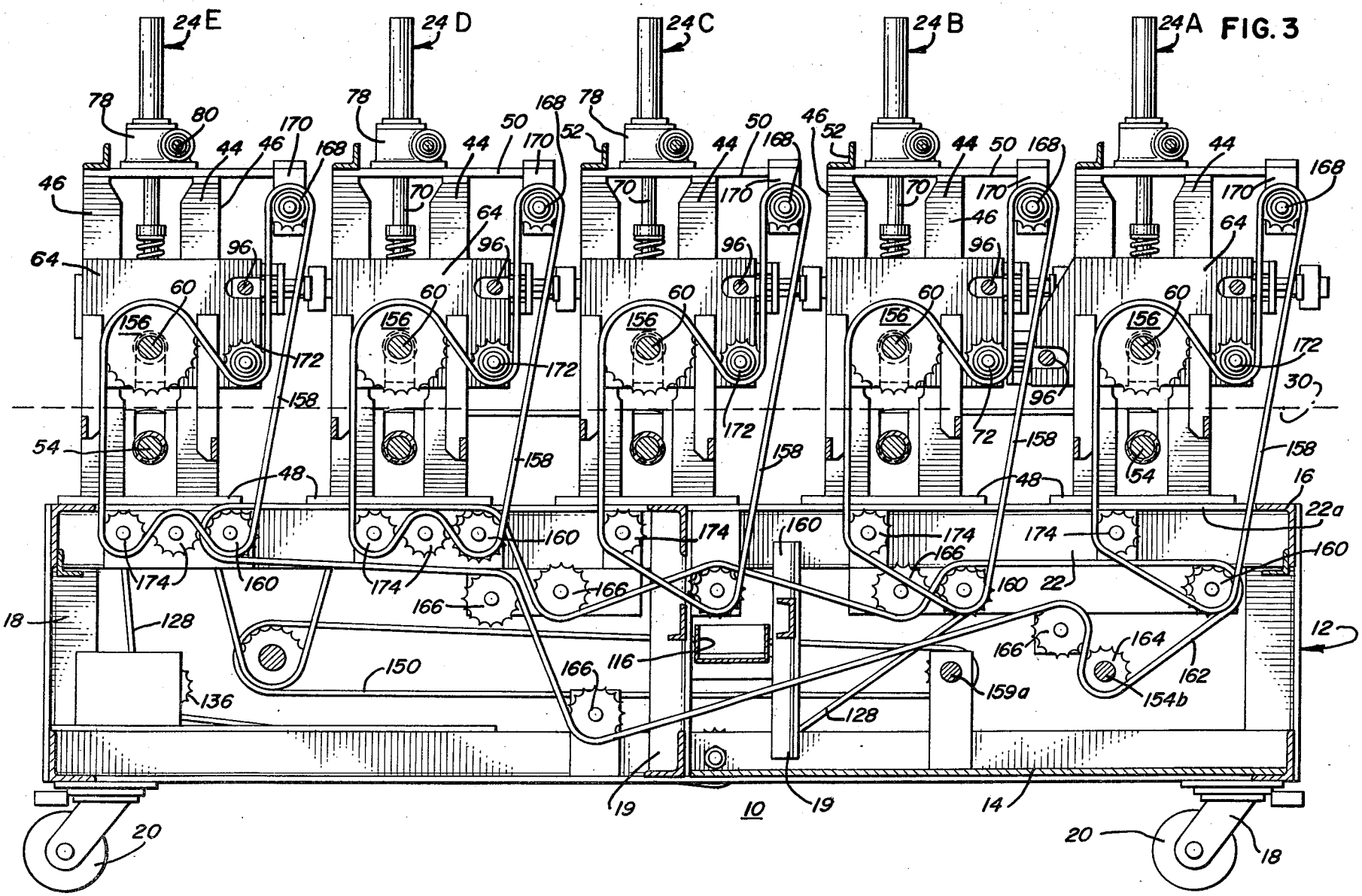
FIG. 3. is a longitudinal vertical sectional view taken substantially along lines 3—3 of FIG. 2.
Figure 4:
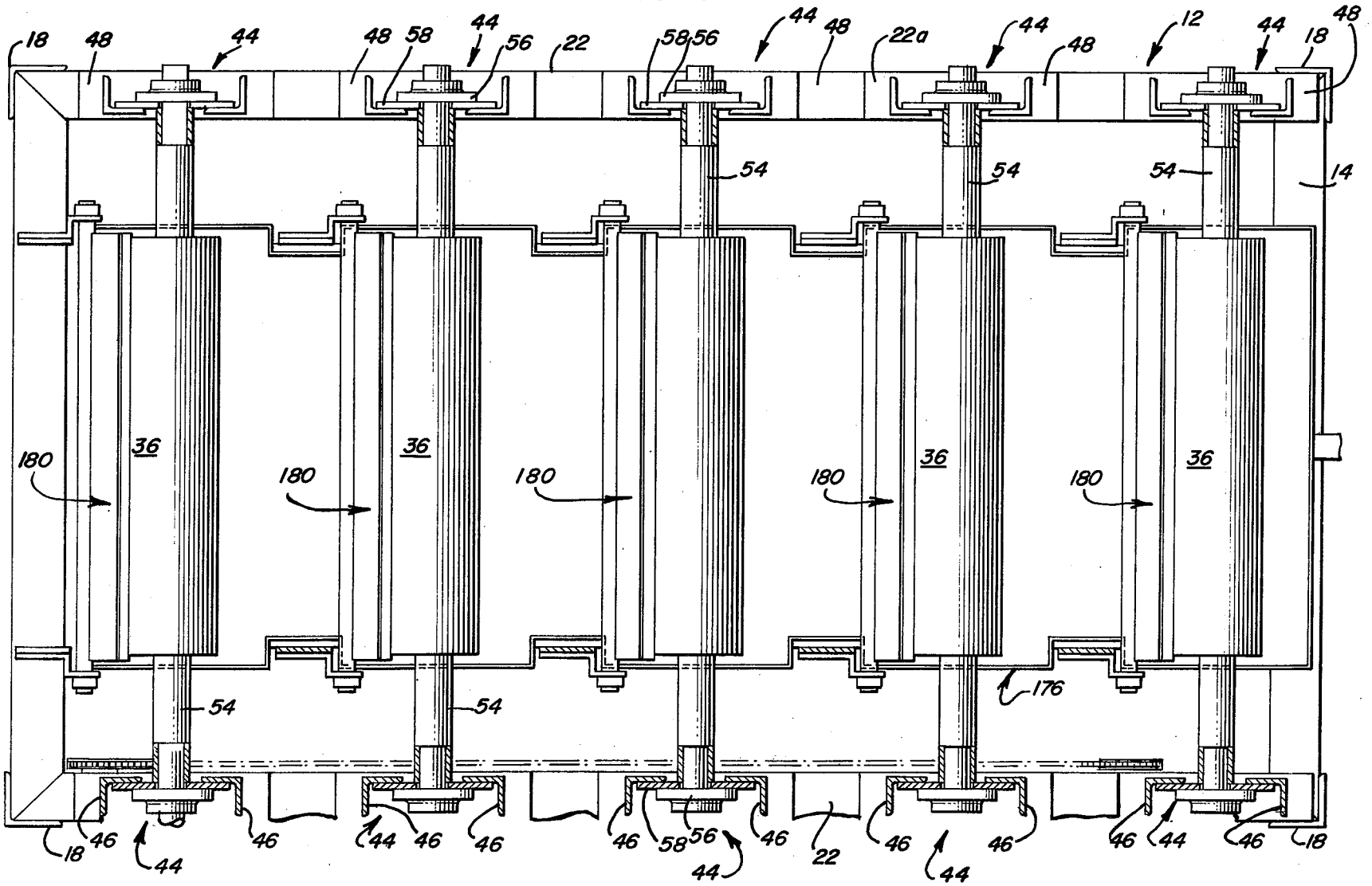
FIG. 4 is a horizontal sectional view taken substantially along lines 4—4 of FIG. 1.

As viewed in FIGS. 1 and 3, the apparatus 10 is adapted to handle relatively large size sheets (for example, 4 × 8) of decorative panels and the like which are indicated by the reference numeral 28 and these panels move along a horizontal work path 50 (dotted lines, FIG. 3), through the apparatus 10 in a direction from left to right as viewed in FIG. 1, indicated by the arrow A.

Figure 2:
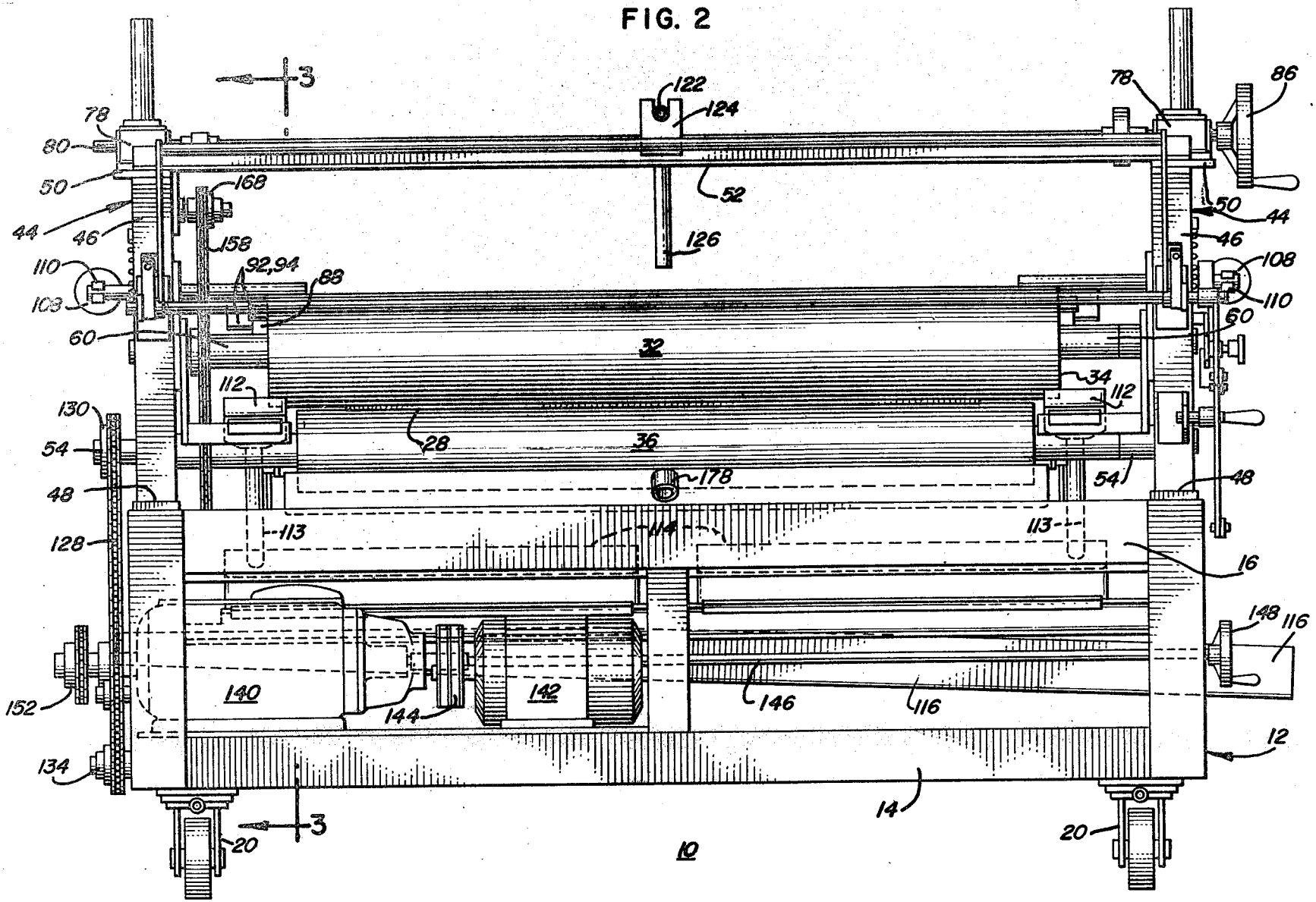
FIG. 2 is an elevational end view of the exit end of the apparatus of FIG. 1.
Figure 5:
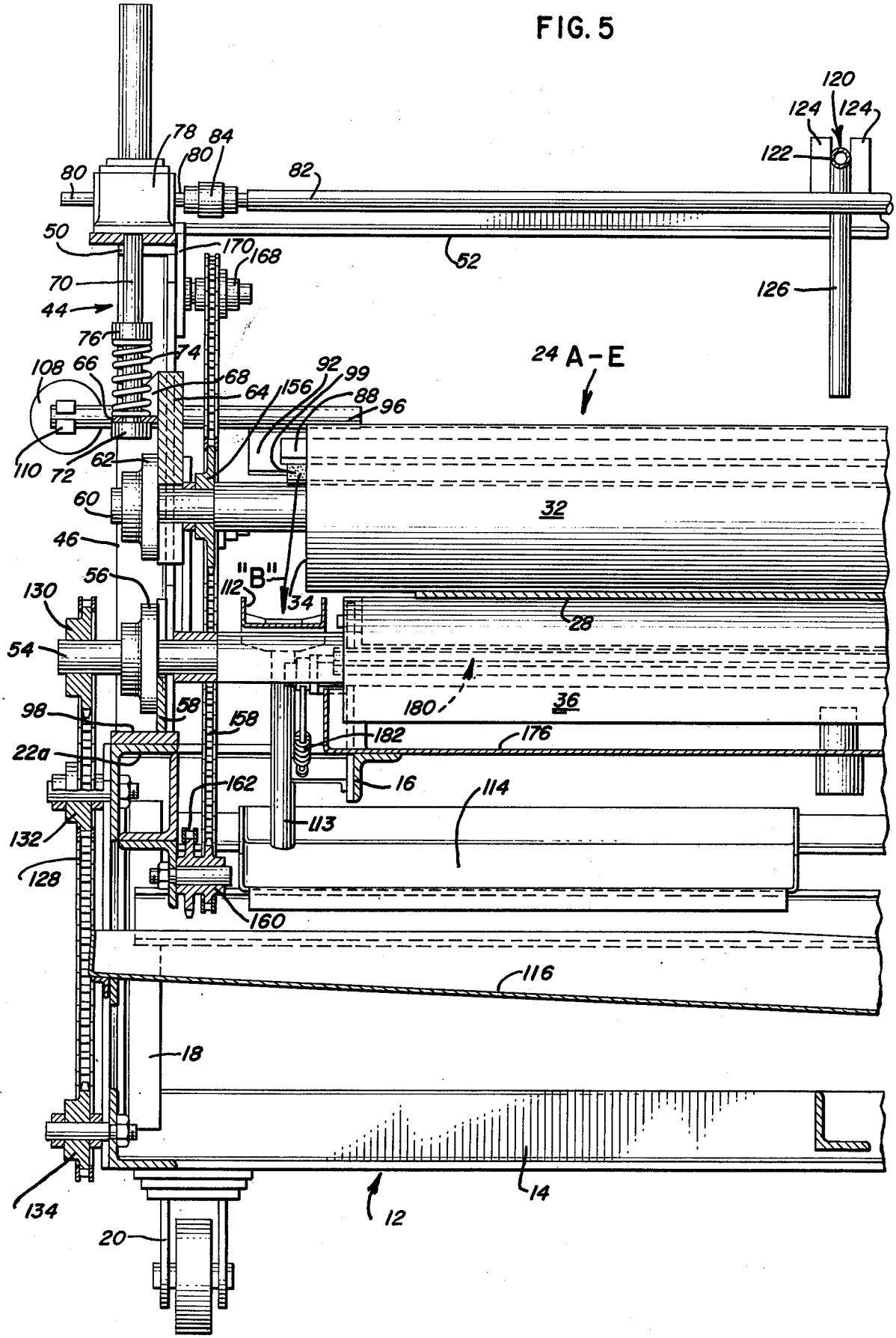
FIG. 5 is a transverse vertical sectional view taken substantially along lines 5—5 of FIG. 1.

In accordance with the present invention, as the panels 28 move in close succession along the work path 30 through the apparatus 10, the embossed upper surfaces thereof are wipingly engaged by a cylindrical, resilient wiping surface 32 mounted on an upper wiping roll 34 in each of the respective drive and wiping roll assemblies 24A through 24E as best shown in FIG. 2. Below the upper wiping rolls 34, each assembly includes a lower drive roll 36 which supports the underside of the panels 28 and causes the panels to move through the apparatus 10 at a selected speed rate. As best shown in FIGS. 2 and 5, the diameter of the resilient wiping cylinders 32 are larger than the diameter of the lower support rolls 36 and as shown in FIG. 1, the lower support rolls are driven in a clockwise direction while the upper wiping rolls 34 are driven in a counterclockwise direction and rotate at a different peripheral speed at least 15% higher than the lower rolls to provide resilient wiping contact with the embossed upper surface of the panels 28 for removing liquid colorant from higher surface portions thereof.

The panels 28 are moved along the work path 30, by the frictional driving engagement between the undersurface of the panels and the cylindrical surface of the lower, driven support rolls 36 and are biased downward against these rolls by the resilient wiping rolls 32. Each of the drive and wiping roll assemblies 24A through 24E includes an upstanding support frame generally indicated by the reference numeral 44 and each support frame includes a pair of upstanding side angles 46 mounted on a base 48 at the lower end to rest on the upper flange 22a of the base 12. At the upper end, each angle 46 is provided with a horizontal top plate 50 and a transverse angle of 52 is provided to structurally interconnect the pairs of frames 44 on opposite sides as best shown in FIG. 2.

Each lower support roll is provided with a pair of stub axles 54 extending outwardly at opposite ends and as shown at FIG. 2, the stub axle on the left hand end of the rolls are slightly longer in order to provide for driving connection with a motor power source as will be described hereinafter. Each stub axle 54 is journaled for rotation in a flange type bearing unit 56 secured to a mounting plate 58 which in turn is secured to the spaced angles 46. The precise position of the bearings 56 on the respective bases 58 is adjusted to provide for accurate horizontal alignment of the lower drive rolls 36 so that the roll surfaces are precisely tangent to the lower plane of the work path 30.

Each of the upper wiping rolls 34 is provided with a pair of stub axles 60 extending outwardly from opposite ends and the stub axles 60 are similar to the stub axles 54 of the lower drive rolls 36. The stub axles 60 are journaled in flange type bearings 62, which in turn are secured to vertically adjustable slide blocks 64 mounted for sliding movement on the aligned facing flanges of the spaced angles 46 of each side frame 44.

In order to selectively adjust the level of the slide blocks 64 on the angles 46, each slide block is provided with an outwardly extending, horizontal bracket 66 secured to the outer surface of the block and a pair of triangularly shaped gussets 68 (FIG. 5) are provided for strengthening the brackets. Each horizontal bracket 66 is formed with a circular opening in order to receive the lower end portion of a vertical support rod 70 having an enlarged annular end stop or collar 72 at the lower end portion to underlie the bracket 66, as best shown in FIG. 5. The brackets 66 and their respective slide blocks 64 are biased downwardly against the stop 72 by means of coil springs 74 coaxially mounted on the lower end portion of the support rods above the brackets. The compression on the springs is adjustably controlled with collars 76 secured on the rods above the springs. The level of the stops 72 and the compression on the springs 74 controls the wiping pressure exerted by the resilient wiping cylinder 32 of the upper wiping rolls 34 on the panels 28. By changing the level of the stops 72 or the spring compression, the amount of wiping pressure on the panels 28 moving along the work path 30 is selectively controlled.

Upper end portions of the support rods 70 are threaded (not shown) and extend into right angle drive, gear boxes 78 which are mounted atop the upper plates 50 on the frames 44. The threaded upper end portions of the support rods 70 are driven to move up and down by gearing in the gear boxes connected with transversely extending horizontal drive shafts 80 extending outwardly from opposite sides of the gear box housings. Each of the drive and wiping roll assemblies 24A through 24E includes one pair of the right angle gear drive units mounted on opposite side frames 44. The shafts 80 of each pair of gear box units 78 are interconnected by a central shaft 82 and a pair of couplings 84 (FIG. 5). A hand wheel 86 is mounted on the outer end of at least one of the gear box shafts 80 and turning of the hand wheel adjusts in unison the vertical position of both of the support rods 70 and respective slide blocks 64 at opposite sides of each pair of frames. From the foregoing it will be seen that the lowest level of the upper wiping rolls 34 relative to the work path 30 is selectively controlled by use of the hand wheels 86 which control the elevation of the lower stops 72. The upper position limit of the wiping rolls is controlled by the compression springs 74 as the panels 28 move between a lower drive roll 36 and its respective upper wiping cylinder 39. The wiping rolls are urged downwardly by the biasing springs 74 on each of the control rods 70 and, depending upon the level of the stops 72 as selected by the hand wheel 86 and the thickness of the panels 28, the wiping pressure is selectively controllable as desired to remove the prescribed amount of liquid colorant from the higher portions of the upper surface of the panels 28. The panel wiping pressure provided at each of the drive and wiping roll assemblies 24A through 24E is independently controllable by a separate hand wheel 86 in order to provide the desired surface effect on the panels 28. For example, as the panels 28 pass along the work path 30 from left to right (FIG. 1), the wiping pressure exerted by the successive cylindrical wiping rolls 32 may be progressively increased, it may be progressively decreased or it may be maintained at about the same level at each wiping station.

As the panels 28 are propelled along the work path 30 by driving contact with the rolls 36, they are biased downwardly against the lower drive rolls by the pressure exerted by resilient wiping cylinders 32 on the upper wiping rolls 34, as best shown in FIG. 5. As the upper surface of the panels pass in wiping contact with the resilient wiping cylinders, some of the liquid colorant material on the higher portions of the panel surfaces may be transferred into the lower areas and the residual or excess is wiped up by the surface of the wiping cylinder. The amount of colorant wiped up by the wiping cylinders from the panels depends on the depth of the embossing, the wiping pressure, the viscosity of the colorant material and relative wiping speed between the panel surface and wiping roll surface.

The colorant material wiped away is carried away from the panel on the surface of the wiping rolls and is subsequently removed from the roll surface by a doctor blade 88 associated with each roll. In order to insure that the wiping cylinder 32 of the first drive and wiping roll assembly 24A contacting the incoming panels 28 is free of all colorant wiped away, the cylinder is provided with a pair of doctor blades in diametrically opposite positions thereon. The first doctor blade removes most all of the colorant and the second blade removes any remaining colorant on the first wiping cylinder 32.

The roll cleaning doctor blades 88 are constructed of relatively stiff but somewhat flexible sheet material and are mounted to angularly intersect the cylindrical surface of resilient wiping cylinders at an acute angle. The pressure of contact between the outer edge of the doctor blades and the surface of the wiping cylinders is adjustable as is the precise angle of contact. Each doctor blade is supported in a relatively stiff support structure comprising a pair of support angles 92 and 94, assembled together to form a pocket for the upper portion of the doctor blade. The support angles 92 and 94 are unequal leg angles and the larger and heavier angle 92 is provided with a long leg for supporting the underside of the doctor blade which is clamped thereto by means of the smaller, unequal leg clamping angle 94. Suitable fasteners are provided for removably securing the clamping angle in place on the leg of the lower support angle 92 and from time to time, should replacement of a doctor blade be necessary, the clamping angle may be readily removed for insertion of a new doctor blade.

At opposite ends, the support angles 92 are provided with stub axles 96 and these axles are supported in flange type, bearing blocks 98. The bearing blocks are mounted for horizontal sliding movement within a guide way formed by a pair of upper and lower horizontal guides 100 attached to the outer surface of the vertically movable slide blocks 64. Accordingly, both a doctor blade 88 and its associated wiping roll 34 are supported to move with the slide blocks 64. The amount of bias or pressure of the doctor blades on the wiping cylinders is adjusted by means of one or more cylindrical weights 108 (FIGS. 1 and 5) mounted on lever arms 110 attached to the outer ends of the stub axles 96. By adding more weights to the arms, the amount of contact pressure can be increased as desired. Moreover, the position of the bearings 98 in the slides 100 can be adjusted to increase or decrease the spacing between the axles 96 and the wiping rolls. The free edge of the doctor blades 88 engage the surface of the resilient wiping cylinders 32 and remove the collected colorant therefrom. A collection trough or flow passage for the colorant is formed between the blade and the cylinder and as the level of colorant collected increases, the collected liquid begins to flow outwardly toward opposite ends of the blade. As shown in FIG. 5, the doctor blades 88 extend outwardly beyond the opposite ends of the resilient wiping cylinders 32 and accordingly, the liquid colorant removed by the doctor blades is carried outwardly beyond the end of the wiping cylinders and eventually spills (arrow "B") over into a plurality of removable collecting troughs 112 which are mounted adjacent opposite ends of each wiping cylinder and are positioned directly below the ends of the doctor blades. Each roll is provided with a pair of end troughs 112 (FIG. 2) and as shown in FIG. 1, the end troughs are sloped so that the collected colorant material flows downwardly toward the lower end and passes via hoses 113 into a pair of collection pans 114, each of which is aligned below several of the troughs 112. The pans 114 slope downwardly toward the central portion of the apparatus frame 12 and discharge their contents into a single laterally extending collection trough 116, as best shown in FIG. 2.

Each of the collection troughs is readily removable for cleaning and is supported by suitable members provided on the apparatus frame 12 or the drive and wiping roll assembly frames 44 as the case may be.

In order to aid the flow of collected colorant along the doctor blades for discharge into the collection troughs 112 the apparatus 10 includes a water flushing system generally indicated by the reference numeral 120. The flushing system includes an elongated water conduit 122 running longitudinally of the centered with respect to the base or frame 12 of the apparatus. The conduit is connected to a suitable source of water to provide a controlled flow rate and is supported on a plurality of upstanding brackets 124 mounted on the cross-member angles 52 of the wiping roll assembly frames 44. At each colorant wiping assembly, 24A through 24E, the conduit 122 supplies the needed flush water to a downwardly extending, branch conduit 126 which directs a flow of flushing water into the center of the trough-like channel formed between the doctor blade 88 and the surface of its wiping cylinder 32. The water distributed by the branch conduits 126 helps to move or flush the collected colorant material toward opposite ends of the doctor blade to be collected by the collecting troughs 112.

In accordance with the present invention, the lower drive rolls 36 are driven by means of a single endless chain 128 which is entrained around a plurality of sprockets 130 mounted adjacent the outer end of the stub shafts 54 of the drive rolls, as best shown in FIG. 1. A pair of upper idler sprockets are provided on the side angle 22 of the upper frame section 16 intermediate the wiping roll assemblies 24B and 24C and a pair of lower idler sprockets 134 and 136 are provided to support and entrain the endless chain in the pattern as shown in FIG. 1. The chain is driven by means of a sprocket 138 carried on the output shaft of a variable speed gear reducer 140 mounted on the lower section 14 of the base 12. The variable speed reducer is powered by an electric motor 142 through a V-belt drive 144 and the speed of the output shaft of the reducer may be adjusted as desired to a selected RPM by means of a control shaft 146 and a hand wheel 148.

The wiping rolls 34 are drivingly interconnected to the reducer 140 by means of an endless chain 150 entrained around a sprocket 152 on the input shaft 154a of a second variable speed reducer 154. The stub shafts 60 of each upper wiping roll 34 is provided with a sprocket 156 and a plurality of endless chain loops 158 (FIG. 3) are entrained around these sprockets and are driven by a plurality of lower dual sprockets 160 supported from the right side angle 22 of the upper frame section as shown.

The dual sprockets 160 are driven by an endless chain 162 which is powered at a selectively controllable speed from an output sprocket 164 mounted on the output shaft 154b of the second gear reducer 154. As shown in FIG. 3, the endless chain 162 is entrained around a plurality of idler sprockets 166 supported from the apparatus base 12 and proper tension and driving connection between the output shaft **154*b* of the reducer and all of the dual drive sprockets 160 of the individual chain loops 158** is insured.

Each chain loop 158 is entrained about an upper idler sprocket 168 mounted on a slide block 64 to move vertically with its associated upper wiping roll 34 and tension on the endless chain loops 158 is adjustable by changing the position of the upper idler sprockets which are mounted on axles secured within vertical slots provided in brackets 170 extending downwardly from the upper plate 50 of the side frames 44, as best shown in FIGS. 1 and 3. Each chain loop also includes an additional idler sprocket 172 mounted on the associated slide block 64 and an idler sprocket or air of sprockets 174 adjacent the lower end of the chain loop.

The peripheral contact speed or relative speed differential between the upper wiping roll surfaces 32 and the panels 28 moving through the apparatus 10 is adjusted by varying the gear ratio of the reducer 154 so that the proper wiping action is obtained. Tests have indicated that excellent wiping action occurs when the peripheral speed of the wiping cylinders 32 is about 15% greater than the speed of the moving panel along the work path.

In accordance with the present invention, the driving support rolls 36 are mounted so that a lower portion of each roll is wetted by water contained in a pan 176 which is mounted beneath the rolls as shown in FIG. 5. Fresh liquid is supplied to the pan with a float controlled valve (not shown) and a drain 178 is provided at one end to discharge excess water. As the rolls 36, turn, their surface is continuously wetted by the liquid in the pan and this wetted roll surface moves into contact with the underside of the panels 28 moving along the work path. It has been found that wetting the underside of the panels prevents the accumulation of static charges on the surfaces thereof and this in turn eliminates the problem of dirt, dust and other particles tending to collect on the surfaces and causing defects in the paint or other surface treatment. After passing through the apparatus 10, the panels 28 are relatively free of static surface charges and further painting or staining operations can be conducted with a minimum of cleaning being required.

In order to prevent excessive build up of water on the surface of the lower drive rolls 36, each roll is doctored with a doctor blade assembly 180 and these doctor blades are similar generally to those on the upper rolls 34 and accordingly, will not be described in detail. The lower doctor blades are biased against the rolls by means of springs 182.

As a safety feature, the apparatus 10 is provided with a safety bar 184 at each end, as shown in FIG. 1. The safety bars are supported at opposite ends by levers 186 which are pivotally mounted on the frame 12. The levers are interconnected by a push rod linkage system 188 which actuates a safety switch 190 when either bar 184 is depressed inwardly toward the frame of the apparatus. The safety switch is wired to cut off the power to the motor 142 when it is activated.

From the foregoing it will be seen that the wiping pressure exerted on the panels 28 by the resilient, cylindrical wiping rolls 32 of the upper rolls 34 is readily controlled by means of the individual hand wheels 86 for each assembly 24A through 24E. The position of the upper collars 76 on the support rods 70 provide for adjustment and maintenance of the desired amount of compression on the bias springs 74 which bias the wiping rolls against the panels. Each successive drive and wiping roll assembly 24A through 24E can be individually adjusted to remove the desired amount of colorant from the higher surface portions of the embossed panels 28 passing along the work path 30 through the apparatus 10. A single hand wheel 86 is operable to raise or lower the opposite ends of each roll and parallel alignment of the lower drive roll 36 and its associated upper wiping roll 34 is thus obtained at all times.

The doctor blades 88 are positioned adjustable to provide both a variable contact pressure and a variable angle of engagement against the wiping cylinders 32. Adjustment of the doctor blades may be required from time to time as wear occurs in order to insure that no colorant material remains on the surface of the wiping cylinders 32 after they pass the line of contact with the doctor blades prior to initial contact with the incoming upper surface of the moving panels 28.

The moving decorative panels 28 are treated by the apparatus 10 to provide a new and improved panel surface appearance wherein the higher portions of an irregular, embossed upper panel surface may be highlighted by the controlled removal of colorant liquid while the liquid is wet. In accordance with the method of the invention, the panels are first covered with a base coat of colorant material on the surface which is allowed to fully dry. Following the first coating, the embossed surface is covered with a second liquid colorant applied to the surface. At this time the surface may then be printed, flashed dry and then the surface would be covered with a liquid colorant. While still wet, selected higher portions of the embossed surface are wiped by the cylinders and the colorant is either wiped into the recessed areas, or is fully or partially removed from these portions as the panels pass through the apparatus 10 constructed in accordance with the present invention. The resultant panel does not suffer from the problem of flashing as is prevalent in the prior art and an extremely attractive surface is provided. The amount of colorant removed and the areas of the higher portions of the embossed panels from which the colorant is removed can be controlled with precision in the apparatus by adjusting the wiping pressure of the resilient wiping cylinders acting on the surface of the panels and by adjusting the successive doctor blades.

The wiping rolls 34 are driven at a peripheral contact speed about 15% greater than the speed of the lower supporting drive rolls 36. This arrangement insures that the desired amount of colorant is wiped off the higher portions of the embossed panels 28. The lower rolls provide a means for wetting the bottom of the panels and this reduces the possibility of static electric charges accumulating on the surfaces of the panels 28 and the resultant cleaning problems that would otherwise ensue.

In making embossed decorative panels in accordance with the invention, panels of fibrous material are first covered with a precision ground coat which is then dried. Next a colorant such as stain, is applied and the panels are passed through the apparatus 10 while the stain is still wet so that portions of the stain on higher surface sections of the embossed surface is removed fully or partially by the wiping action as described hereinbefore while the bottom of the panels are wetted. The panels are then printed and a final covering or seal coat is then applied. The resultant panels look truly like actual wood panels. The printing may be applied over the ground coat before the stain is applied and wiped as described.

Although the present invention has been described with reference to several embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. Apparatus for removing liquid colorant from the surface of sheet material such as decorative panels and the like comprising:

a drive roll means underlying said panels for moving the same along a generally horizontal work path at a selected speed;

at least one driven wiping roll means supported on an axis above said work path having a cylindrical resilient wiping surface driven to wipingly engage an upper surface of said panels passing under said wiping roll means carried by said driven roll means;

said wiping roll means including motor means for driving said wiping surface to contact said upper surface of said moving panels at a speed at least 15% higher than said speed of said panels along said work path;

means resiliently supporting said wiping roll means for movement toward and away from said work path to provide selectively adjustable wiping pressure against said surface of said moving panels;

blade means angularly engaging said wiping surface of said wiping roll means along a line of contact spaced away from the area of wiping contact with said panels for removing liquid colorant from said wiping surface; and trough means adjacent opposite ends of said blade means for receiving liquid colorant removed from said wiping surface.

2. The apparatus of claim 1 including means for supporting said blade means for movement toward and away from said wiping surface of said wiping roll means.

3. The apparatus of claim 2 including adjustable means for biasing an edge of said blade means against said wiping surface of said wiping roll means to increase or decrease the pressure along said line of contact.

4. The apparatus of claim 1 including adjustable means for selectively controlling the amount of resilient bias of said wiping roll means toward said panels moving along said work path.

5. The apparatus of claim 4 including stop means for limiting the movement of said wiping roll means downwardly toward said work path.

6. The apparatus of claim 1 including a plurality of said drive roll means and a plurality of said wiping roll means spaced along said work path, said means for supporting said wiping roll means including independently adjustable control means for selecting the amount of resilient bias of each of said wiping roll means toward said work path.

7. The apparatus of claim 6 wherein pairs of drive roll means and wiping roll means are in vertical alignment, and said pairs are spaced apart horizontally along said work path.

8. The apparatus of claim 6 including drive means for drivingly interconnecting said plurality of drive roll means.

9. The apparatus of claim 6 including adjustable speed drive means for drivingly interconnecting said plurality of wiping roll means independent of the speed of said drive roll means.

10. The apparatus of claim 1 including means for wetting the surface of said drive roll means for wetting one side of panels moving through said apparatus.

11. The apparatus of claim 10 including blade means for doctoring said drive roll means.

* * * * *